US005558078A

United States Patent [19]

Dunlap

[11] Patent Number: 5,558,078

[45] Date of Patent: Sep. 24, 1996

[54] ARCHERY BOW STABILIZER

[76] Inventor: Patrick J. Dunlap, 13290 Table Rock Rd., Central Point, Oreg. 97502

[21] Appl. No.: 334,148

[22] Filed: Nov. 4, 1994

[51] Int. Cl.[6] ..... F41B 5/20

[52] U.S. Cl. ..... 124/8.9; 124/86

[58] Field of Search ..... 124/23.1, 24.1, 124/25.6, 44.5, 86, 87, 88, 89; 403/331, 337, 373

[56] References Cited

U.S. PATENT DOCUMENTS

| | | | |
|---|---|---|---|
| 3,179,102 | 4/1965 | Peckham | 124/88 X |
| 3,377,999 | 4/1968 | Reynolds | 124/88 |
| 3,412,725 | 11/1968 | Hoyt, Jr. | 124/89 |
| 3,524,441 | 8/1970 | Jeffrey | 124/89 |
| 3,840,944 | 10/1974 | Gresley | 124/88 X |
| 4,615,327 | 10/1986 | Saunders | 124/89 |
| 4,788,961 | 12/1988 | Toth | 124/87 X |
| 5,297,533 | 3/1994 | Cook | 124/88 |
| 5,339,793 | 8/1994 | Findley | 124/89 |
| 5,388,563 | 2/1995 | Hsu | 124/23.1 |

*Primary Examiner*—John A. Ricci
*Attorney, Agent, or Firm*—James D. Givnan, Jr.

[57] ABSTRACT

A bow stabilizer having a quick release clamp assembly at one end actuated by manual rotation of a weight member of the stabilizer. A shoulder and washers of the clamp assembly engage a groove wall and end wall of a bow mounted retainer during stabilizer installation.

5 Claims, 1 Drawing Sheet

ARCHERY BOW STABILIZER

BACKGROUND OF THE INVENTION

The present invention pertains to devices termed stabilizers for attachment to archery bows to diminish oscillation of the bow subsequent to arrow release.

In common use today in the field of archery are bow stabilizing devices termed stabilizers in the trade. Such devices typically provide a weighted body offset from the bow with the inertia of the body serving to resist horizontal as well as rotational forces imparted to the bow during arrow release. Archery bows as manufactured commonly include threaded socket for stabilizer attachment which entails the seating of a threaded stud of the stabilizer in the threaded socket in a snug manner. As the archer may wish to remove or substitute stabilizers for purposes of accuracy, considerable time may be spent in such tasks over a day's time.

Prior art stabilizers include those disclosed in U.S. Pat. No. 3,412,725 which include a resilient component to modulate the action of the stabilizer. Similarly the stabilizer disclosed in U.S. Pat. No. 3,524,441 utilizes a rubber sleeve to isolate a stabilizer arm from the archery bow.

SUMMARY OF THE PRESENT INVENTION

The present invention is embodied within a stabilizer for archery bows having a clamping feature permitting rapid attachment and separation of a stabilizer form an archery bow.

The present stabilizer includes a weighted mass offset from an archery bow and preferably attached adjacent the bow handle grip. The present stabilizer is provided with a clamp assembly actuated by minimal rotation of the stabilizer to effect positive locked engagement with a stabilizer support or holder member which may be left in place in the stabilizer socket of the bow. Separation of the present stabilizer is accordingly in a quick-release manner and, conversely, attachment is readily accomplished by partial stabilizer rotation without the aid of any tool. If so desired, range of stabilizer weighted bodies may be provided to allow the archer a selection of the proper stabilizer weight best suited to the archery shot at hand.

Important objectives include the provision of an archery bow stabilizer including a quick release clamp assembly engageable with the bow mounted holder or retainer; the provision of an archery bow stabilizer which utilizes a quick release clamp assembly operable in conjunction with a bow mounted retainer to enable rapid stabilizer removal and attachment to a bow with minimal effort; the provision of an archery bow stabilizer that permits use of a selected stabilizer attachable in an interchangeable manner to an archery bow.

DETAILED DESCRIPTION OF THE PREFERRED EMBODIMENTS

Figures 1, 2, 3, 4, 5:
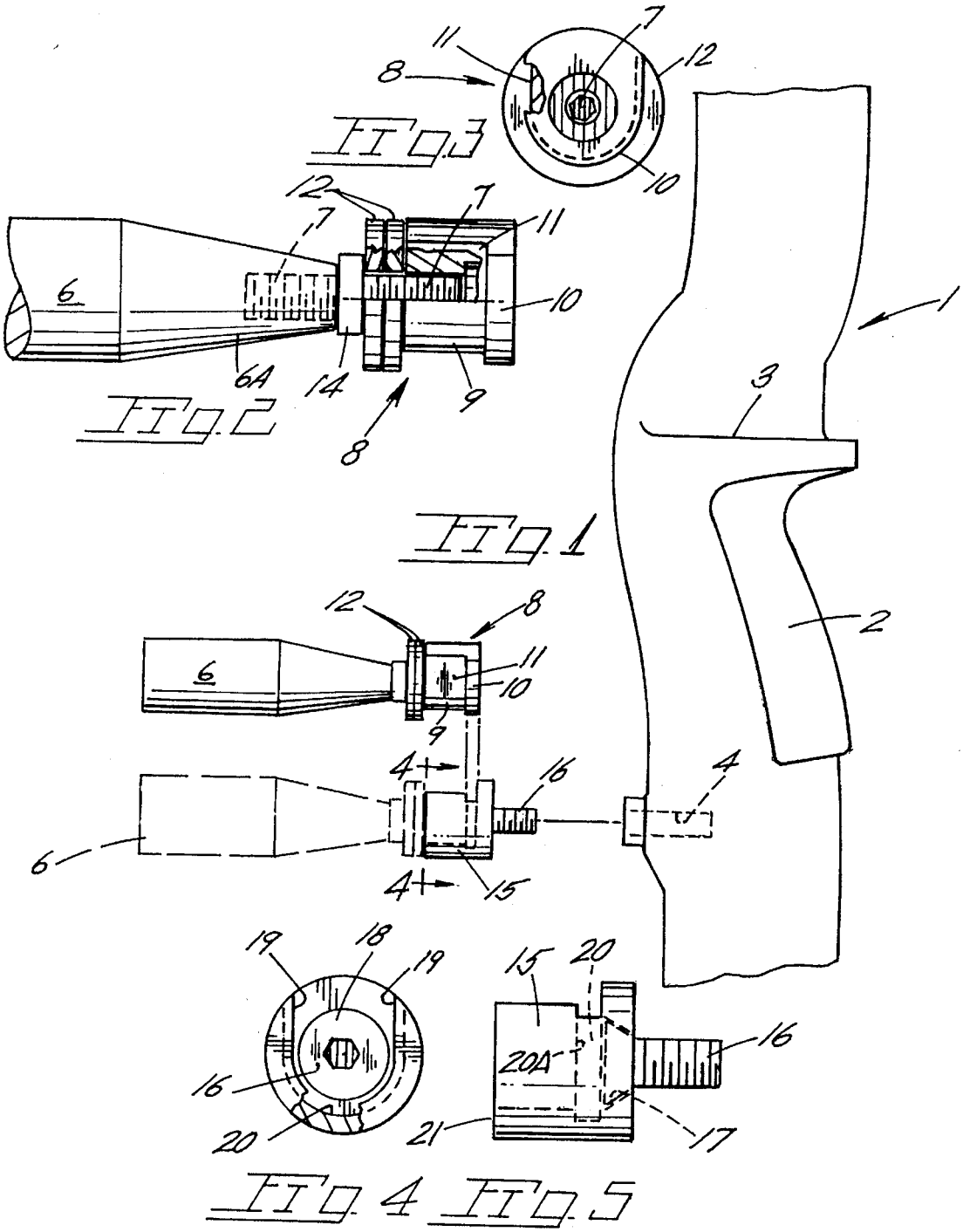
FIG. 1 is a fragmentary side elevational view of an archery bow with the present stabilizer exploded therefrom per phantom direction lines.
FIG. 2 is an enlarged fragmentary side elevational view of the present stabilizer with clamp assembly thereon.
FIG. 3 is an elevational view from the right hand end of FIG. 2.
FIG. 4 is an end elevational view taken along line 4—4 of FIG. 1.
FIG. 5 is an enlarged side elevational view taken from the right side of FIG. 4.

With continuing attention to the drawings wherein applied reference numerals incidate parts similarly identified below, the reference numeral 1 indicates generally an archery bow which may be of the compound type shown with a grip 2 and an arrow shelf 3. An internally threaded socket at 4 is provided in most current archery bows for the reception of the stabilizing device fitted with a threaded stud.

With attention now to the present stabilizer, the same includes a weight member 6 which may be elongate with a neck 6A. A threaded stem 7 on member 6 serves to actuate the following described clamp. A clamp assembly generally at 8 is located at the proximal end of stabilizer body 6 and includes a clamp 9 of U-shape in section with side walls 11. A lip or rim 10 projects laterally to form a head of the clamp. Washers at 12 along with rim 10 provide opposed clamping surfaces engageable with a later described retainer. The threaded stem 7 carried by weight member 6 engages an internally threaded bore of clamp 9 and additionally is locked in engagement with the stabilizer weight member 6 by a nut 14. Accordingly, upon rotation of the member 6 threaded stem 7 will be advanced into clamp 9 to draw rim 10 thereon toward washers 12.

With attention now to FIGS. 4 and 5 wherein a retainer 15 of the stabilizer is shown, the same includes a threaded stud 16 for engagement with internally threaded bore 4 of the bow. A suitable fastener for retainer attachment may be a flat head machine screw with the head thereof seated within a conical recess 17 in the retainer. A U-shaped recess 18 is partially defined by parallel internal walls 19 which terminate inwardly in a U-shaped groove 20 in which rim 10 seats during attachment of the clamp assembly 8 to the retainer.

During installation of weight member 6 and the clamp assembly carried thereby, clamp 9 is moved laterally to slideably engage rim 10 with groove 20, whereafter rotary movement of weight member 6 urges a washer 12 into abutment with an end wall 21 of the retainer while rim or shoulder 10 is biased into contact with a groove wall 20A. In the preferred form of the invention, such snug installation of clamp assembly 8 to the retainer is effected by partial rotation of weight member 6 about its axis on the order of 90 degrees or so. The clamp 9 is of an axial dimension to assure abutting engagement of a washer 12 with retainer end wall 21 during securement of weight member 6 in place.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. An archery bow stabilizer comprising, a weight member including clamp actuating means, and a clamp assembly having a clamp with opposed surfaces movable by said clamp actuating means, a retainer for attachment to the bow and having spaced apart surfaces engaged by said opposed surfaces of the clamp upon operation of said actuating means, said clamp being of U-shape in cross section and including a shoulder, said retainer being of corresponding U-shape and defining a groove for the reception of said shoulder during attachment of the weight member to the bow.

2. The archery bow stabilizer claimed in claim I wherein said clamp and said retainer include pairs of slidably engaging wall surfaces which confine the clamp against rotation during operation of the actuating means.

3. An archery bow stabilizer comprising, a weight member including a threaded stem, a clamp carried by said threaded stem, a retainer having screw threads for screwed attachment to the bow and having spaced apart surfaces for clamped engagement with said clamp, and said weight member in threaded engagement with said clamp and attachable to said retainer by manual rotation of the weight member.

4. The bow stabilizer claimed in claim 3 wherein said clamp and said retainer include parallel cooperating wall surfaces confining said clamp against rotation during attachment of said weight member.

5. In an archery bow having a threaded socket for reception of a stabilizer having a threaded stud, the improvement comprising, a clamp assembly having a clamp with axially movable members with opposed surfaces thereon, one of said members having an internally threaded bore to receive the threaded stud of the stabilizer whereby rotation of the threaded stud of the stabilizer will impart closing movement to said opposed surfaces, a retainer for attachment to the bow and having fixed spaced apart surfaces engaged by said opposed surfaces upon manual rotation of the stabilizer, said clamp being of U-shape in cross section and including a shoulder, said retainer being of corresponding U-shape and defining a groove for the reception of said shoulder during attachment of the weight member to the bow.

* * * * *